US010492540B2

(12) United States Patent
Liu

(10) Patent No.: US 10,492,540 B2
(45) Date of Patent: Dec. 3, 2019

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 158 days.

(21) Appl. No.: 15/908,798

(22) Filed: Feb. 28, 2018

(65) Prior Publication Data

US 2019/0230983 A1 Aug. 1, 2019

(30) Foreign Application Priority Data

Jan. 29, 2018 (CN) ..... 2018 1 0085473
Jan. 29, 2018 (CN) ..... 2018 2 0150334 U

(51) Int. Cl.
*A24F 13/00* (2006.01)
*A24F 47/00* (2006.01)
*H05B 3/03* (2006.01)

(52) U.S. Cl.
CPC ..... *A24F 47/008* (2013.01); *H05B 3/03* (2013.01)

(58) Field of Classification Search
CPC ..... A24F 47/00
USPC ..... 131/328–329
See application file for complete search history.

(56) References Cited

U.S. PATENT DOCUMENTS

2019/0150510 A1* 5/2019 Conley ..... A24F 47/008
2019/0254344 A1* 8/2019 Hepworth ..... A24F 7/00
2019/0289911 A1* 9/2019 Liu ..... A24F 7/00

* cited by examiner

*Primary Examiner* — Phuong K Dinh
(74) *Attorney, Agent, or Firm* — Matthias Scholl, PC; Matthias Scholl

(57) ABSTRACT

An electronic cigarette, including an atomization module, an e-liquid storage module, and a battery module. The atomization module is disposed on the battery module. The atomization module includes: a mouthpiece, an airflow regulation ring, an air blockage ring, a fixed ring of the air blockage ring, a first seal ring, an upper cover, a seal ring of the air blockage ring, a screw ring, a first press cover, an atomization support, a seal ring of the atomization support, a meshed heating disc, e-liquid conducting cotton, a cotton support, an air plug, a first anode connection member, a second anode connection member, an e-liquid blockage member, a second seal ring, a third seal ring, a base, a fourth seal ring, a glass tube, a fixed ring of the glass tube, a second press cover, a first insulator, and a bottom electrode.

10 Claims, 6 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201810085473.4 filed Jan. 29, 2018, and to Chinese Patent Application No. 201820150334.0 filed Jan. 29, 2018. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The present disclosure relates to an electronic cigarette.

Description of the Related Art

Typical electronic cigarettes are disadvantageous in the following aspects:

1. The atomization module is fixed and cannot be replaced;
2. The replacement of the battery cell is laborious, and tends to damage the outer protective insulation layer of the battery cell;
3. The refilling of the e-liquid is time-consuming, and requires disassembling the electronic cigarettes; and
4. The housing of the electronic cigarettes is integrated and cannot be replaced.

SUMMARY OF THE INVENTION

In view of the above-described problems, it is one objective of the invention to provide an improved electronic cigarette. The replacement of the battery cell and the refilling of the e-liquid of the electronic cigarette are efficient and reliable.

To achieve the above objective, in accordance with one embodiment of the invention, there is provided an electronic cigarette, comprising an atomization module, an e-liquid storage module, and a battery module. The atomization module is disposed on the battery module.

The atomization module comprises: a mouthpiece, an airflow regulation ring, an air blockage ring, a fixed ring of the air blockage ring, a first seal ring, an upper cover, a seal ring of the air blockage ring, a screw ring, a first press cover, an atomization support, a seal ring of the atomization support, a meshed heating disc, e-liquid conducting cotton, a cotton support, an air plug, a first anode connection member, a second anode connection member, an e-liquid blockage member, a second seal ring, a third seal ring, a base, a fourth seal ring, a glass tube, a fixed ring of the glass tube, a second press cover, a first insulator, and a bottom electrode. The first seal ring, the fixed ring of the air blockage ring, the airflow regulation ring, and the mouthpiece are disposed on the upper cover successively to form a cigarette holder and an airflow regulator of the electronic cigarette; the e-liquid blockage member is disposed at a bottom of the second anode connection member; the air plug and the first anode connection member are embedded in an upper part of the second anode connection member successively; the second anode connection member comprises an e-liquid inlet; the meshed heating disc is embedded in the atomization support; the e-liquid conducting cotton is supported by the cotton support; the atomization support is integrated with the cotton support; the seal ring is positioned in the atomization support, and then sleeves the second anode connection member; the first press cover is screwed on the first anode connection member; the second seal ring and the third seal ring are embedded in two upper grooves of the base, and the fourth seal ring is embedded in a lower groove of the base; the fixed ring of the glass tube is disposed in a groove of the second press cover, and the fixed ring and the glass tube are embedded in the base successively; the first insulator and the bottom electrode are disposed in a bottom hole of the base; the second anode connection member is connected to the base; the cigarette holder is positioned on the base.

The e-liquid storage module comprises: a cover, a press ring, a female threaded piece, a male threaded piece, a first spring, a supporting member of the male threaded piece, a fifth seal ring, an e-liquid charging/releasing unit, an e-liquid storage chamber, a suction pipe, and a protective jacket. The female threaded piece communicates with the e-liquid storage chamber, the male threaded piece is supported by the supporting member; the first spring and the e-liquid charging/releasing unit are disposed in the supporting member; the fifth seal ring sleeves the e-liquid charging/releasing unit; the press ring and the suction pipe are disposed on the supporting member successively; the male threaded piece corresponds to the female threaded piece, and the e-liquid storage chamber is disposed in the protective jacket.

The battery module comprises: a sixth seal ring, a threaded plate, an upper electrode, a second screw, a third screw, a second spring, a lower electrode, an electrode cover, a second insulator, a first silica plug, a second silica plug, a first decorative member, a second decorative member, first screws, a copper wire, a battery cell, a bracket, an anode press piece, a first silica plug, an anode connection piece, an anode contact, a circuit board, a fourth screw, a button, a bolt, an upper cell cover, a main body, a rear decorative member, a first threaded press piece, a second threaded press piece, a lower cover, an end cover, and a fifth screw. The threaded plate is disposed on the upper cell cover; the button and the bolt are embedded in the upper cell cover; the first silica plug, the second insulator, the second spring, the upper electrode are disposed in the electrode cover successively; the lower electrode cooperates with the upper electrode; the upper electrode and the lower electrode are integrated with the threaded plate; the first threaded press piece and the second threaded press piece are integrated with the lower cover; the copper wire is welded to the first threaded press piece and disposed at a bottom of the main body; the second silica plug is disposed on the bracket; the first silica plug sleeves the anode press piece and then is disposed at a bottom of the bracket; the anode connection piece is disposed on an upper part of the bracket; the anode contact is disposed on the bracket; the circuit board is disposed on the bracket; the anode connection piece is welded to an anode of the circuit board, and then is mounted in the main body; the copper wire is welded to an cathode of the circuit board; the first decorative member, the second decorative member, and the rear decorative member are fixed on the main body via the first screws; the upper cell cover is mounted on the main body and locked by the fourth screw; the battery cell is disposed in the main body; the end cover is mounted on the lower cover via the fifth screw.

In a class of this embodiment, the meshed heating disc is a circular metal heating net connected to the second anode connection member and a cathode of the battery cell; and the circular metal heating net is connected to the cotton support, the e-liquid conducting cotton, and the atomization support.

In a class of this embodiment, the lower electrode is embedded in the second silica plug; the lower electrode is connected to the upper electrode; the upper electrode is connected to and communicates with the bottom electrode via the threaded plate.

In a class of this embodiment, the threaded plate comprises a groove; the press ring and the fifth seal ring are connected to the suction pipe; the e-liquid charging/releasing unit, the first spring, and the supporting member are embedded in the male threaded piece successively, integrated with the suction pipe, and then cooperate with the female threaded piece.

In a class of this embodiment, the fixed ring of the air blockage ring and the first seal ring are disposed in grooves of the upper cover; the airflow regulation ring is connected to the upper cover; the screw ring and the air blockage ring are fixed in the upper cover, and the mouthpiece is disposed on the upper cover.

In a class of this embodiment, the main body comprises a first trench for accommodating the e-liquid storage chamber and the protective jacket, and a second trench for accommodating the battery cell and the bracket.

Advantages of the electronic cigarette according to embodiments of the disclosure are summarized as follows. The battery cell of the electronic cigarette can be dismantled and replaced as needed, and the battery cell is extracted from a through hole of the main body of the electronic cigarette, preventing the outer protective insulation layer of the battery cell from being damaged. The e-liquid is tightly sealed preventing leakage. The arrangement of the airflow regulation ring facilitates the regulation of the flow rate of the vapor, increasing the user experience. The e-liquid can be refilled during usage of the electronic cigarette, through manually squeezing the e-liquid storage module, the e-liquid can be charged to the atomization module via an e-liquid inlet. When the charging is finished, the e-liquid inlet closes automatically, preventing the leakage of the e-liquid.

DETAILED DESCRIPTION OF THE EMBODIMENTS

Figure 1:
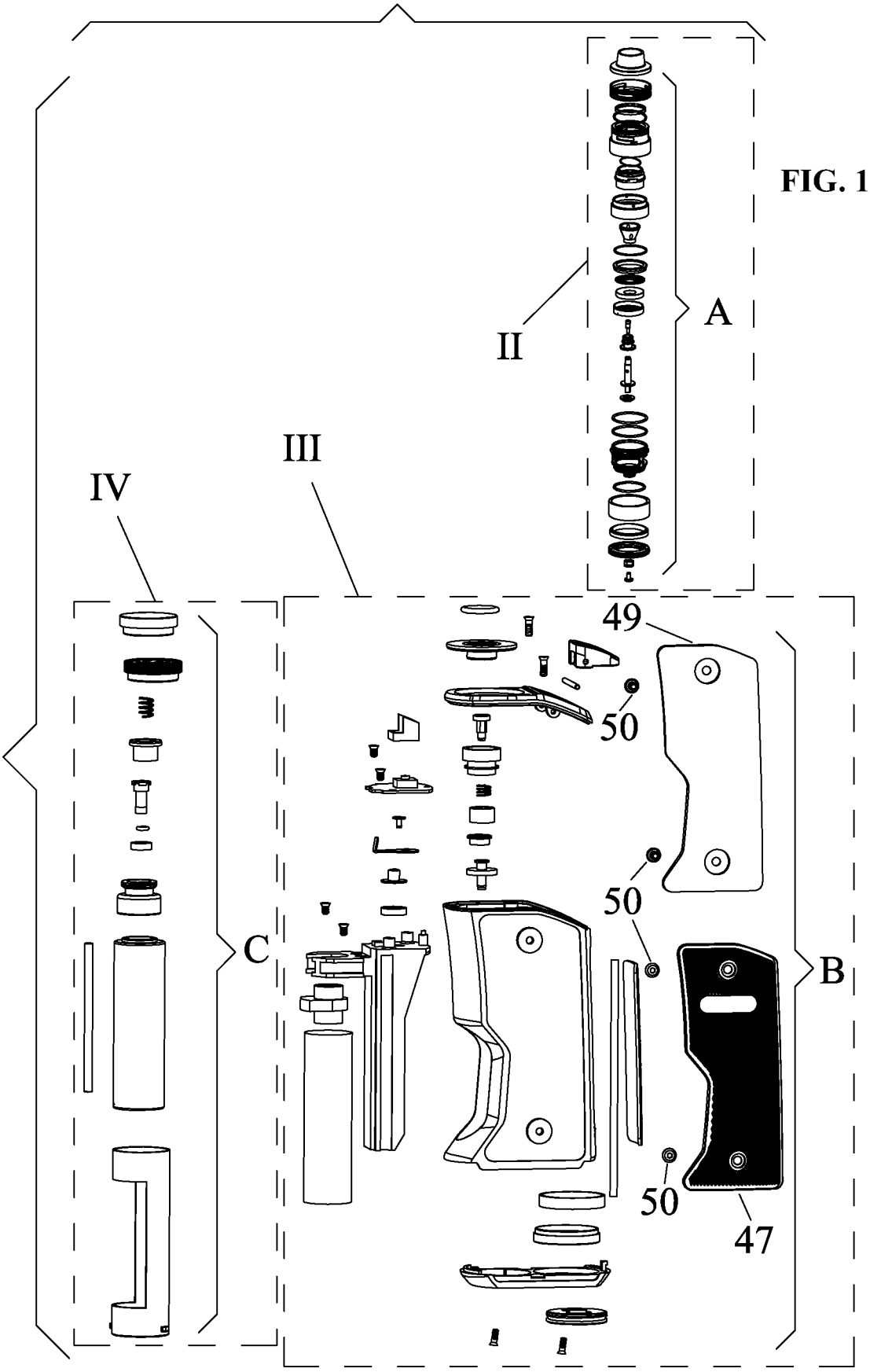
FIG. 1 is an exploded view of an electronic cigarette according to one embodiment of the present disclosure.
Figure 2:
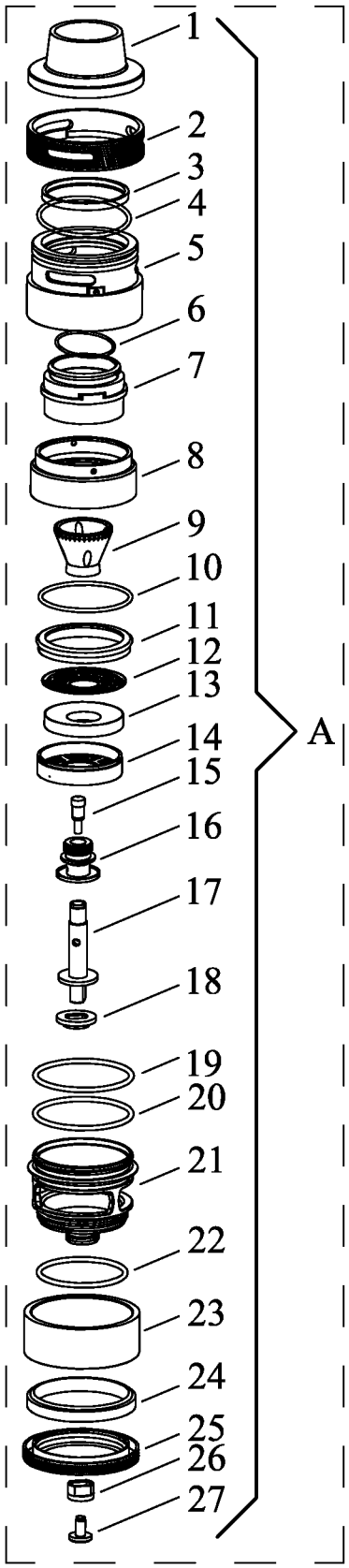
FIG. 2 is a local enlarged view of part II in FIG. 1 according to one embodiment of the present disclosure.
Figure 3:
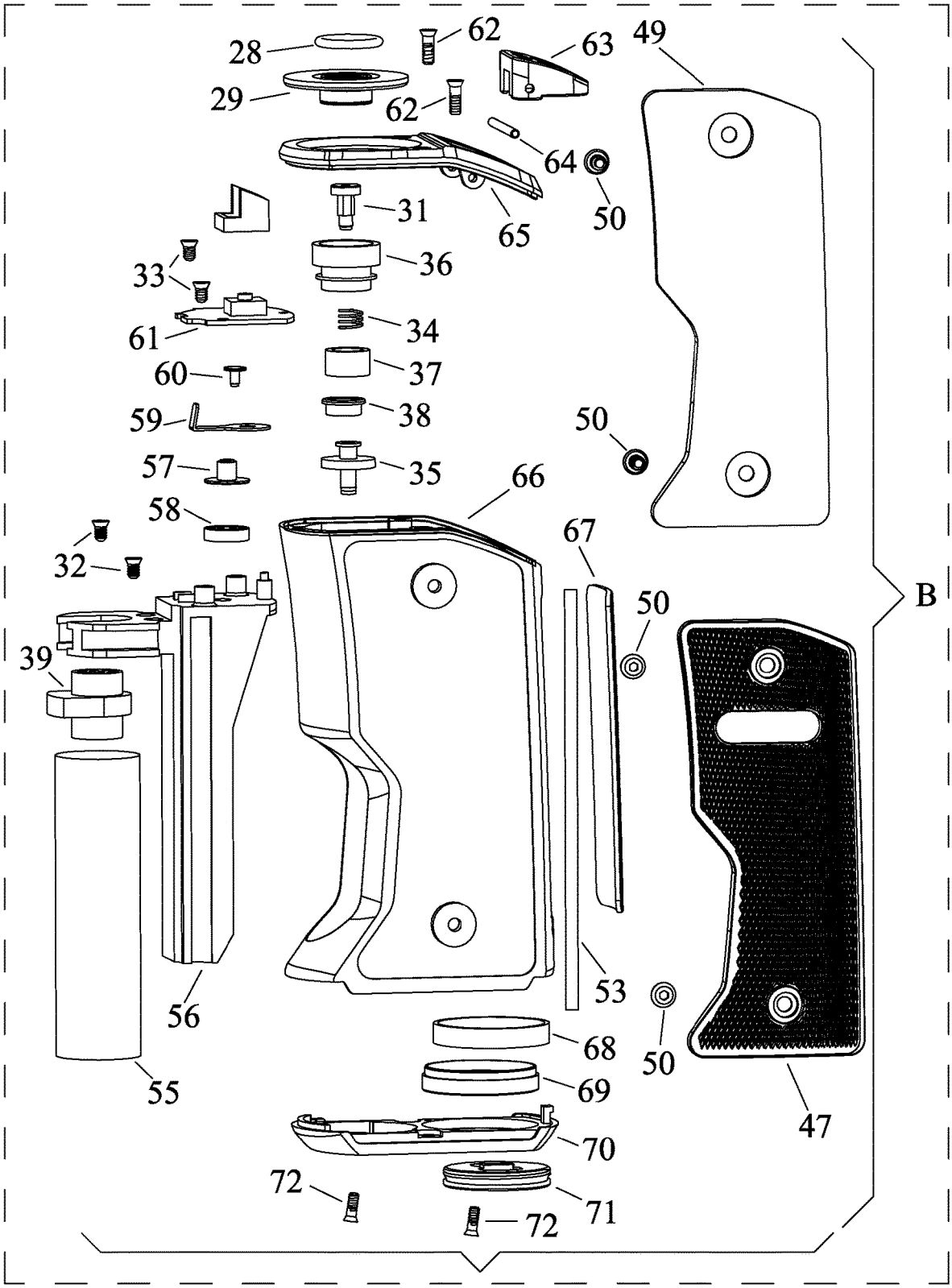
FIG. 3 is a local enlarged view of part III in FIG. 1 according to one embodiment of the present disclosure.
Figure 4:
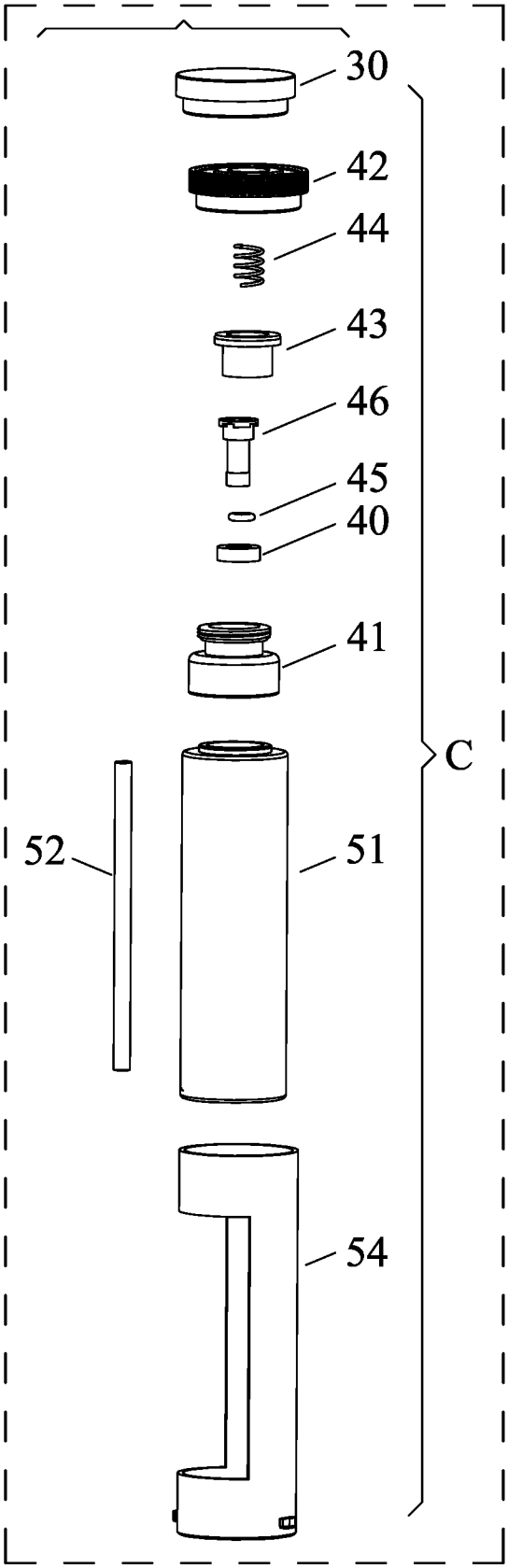
FIG. 4 is a local enlarged view of part IV in FIG. 1 according to one embodiment of the present disclosure.
Figure 5:
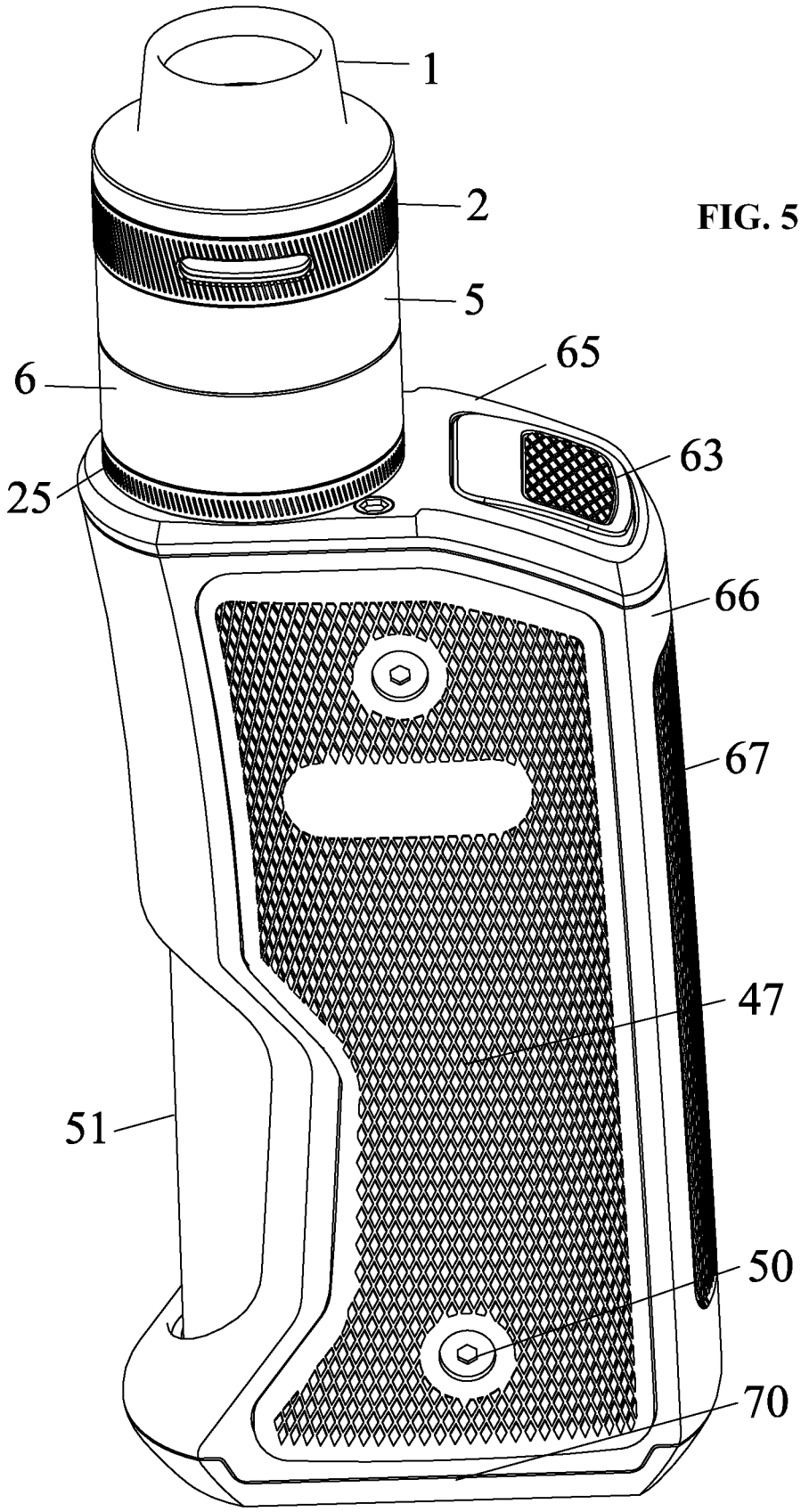
FIG. 5 is a stereogram of an electronic cigarette according to one embodiment of the present disclosure.
Figure 6:
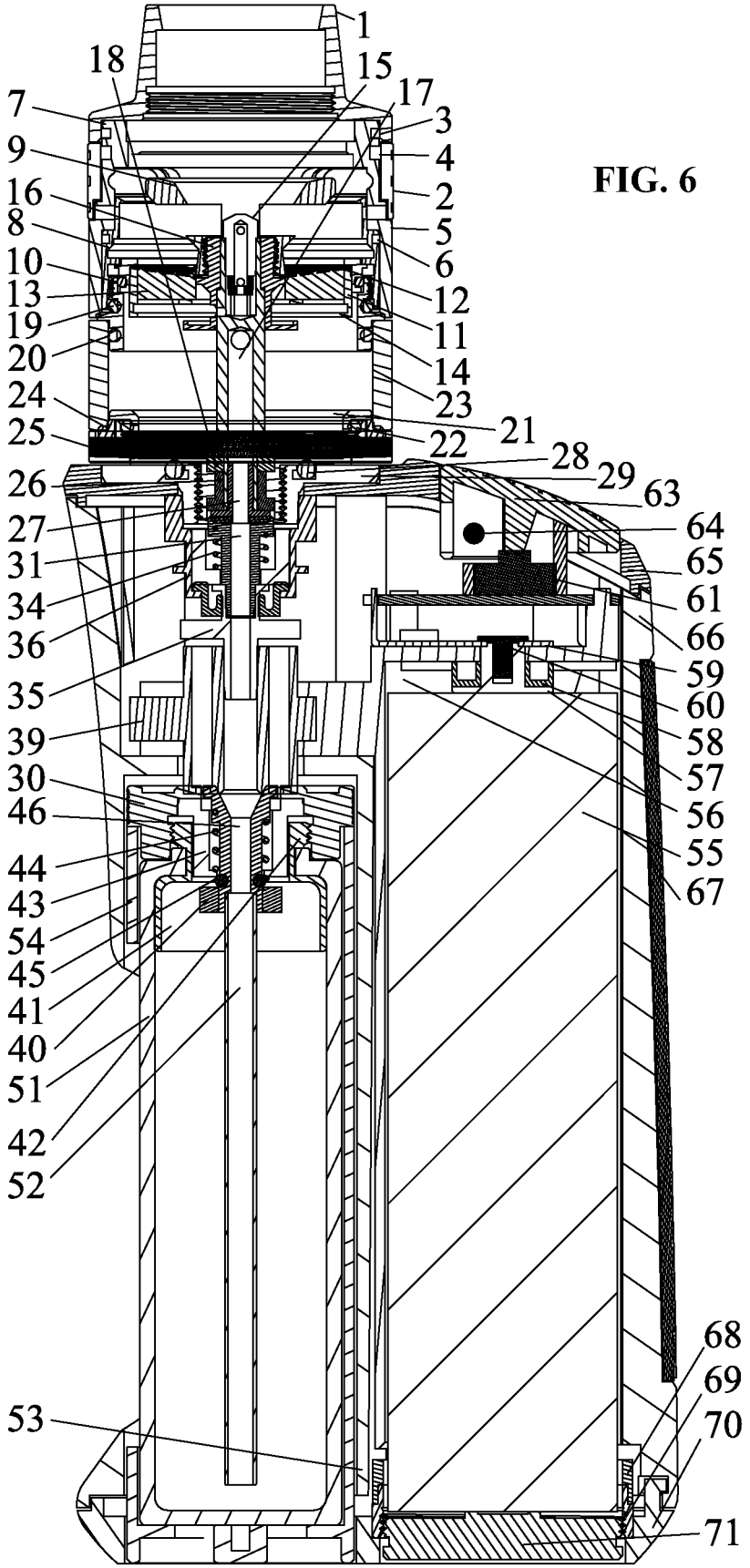
FIG. 6 is a sectional view of an electronic cigarette according to one embodiment of the present disclosure.

To further illustrate the invention, experiments detailing an electronic cigarette are described below. It should be noted that the following examples are intended to describe embodiments and not to limit the invention.

As shown in FIGS. 1-6, an electronic cigarette of the disclosure comprises an atomization module A, a battery module B, and an e-liquid storage module C. The atomization module is connected to the battery module, and when the e-liquid storage module is squeezed manually, the e-liquid is released from the e-liquid storage module to the atomization module. The electronic cigarette comprises: a mouthpiece 1, an airflow regulation ring 2, an air blockage ring 7, a fixed ring 3 of the air blockage ring, a first seal ring 4, an upper cover 5, a seal ring 6 of the air blockage ring, a screw ring 8, a first press cover 9, an atomization support 11, a seal ring 10 of the atomization support, a meshed heating disc 12, e-liquid conducting cotton 13, a cotton support 14, an air plug 15, a first anode connection member 16, a second anode connection member 17, an e-liquid blockage member 18, a second seal ring 19, a third seal ring 20, a base 21, a fourth seal ring 22, a glass tube 23, a fixed ring 24 of the glass tube, a second press cover 25, a first insulator 26, a bottom electrode 27, a sixth seal ring 28, a threaded plate 29, a cover 30, an upper electrode 31, a second screw 32, a third screw 33, a second spring 34, a lower electrode 35, an electrode cover 36, a second insulator 37, a first silica plug 38, a second silica plug 39, a press ring 40, a female threaded piece 41, a male threaded piece 42, a supporting member 43 of the male threaded piece 42, a first spring 44, a fifth seal ring 45, an e-liquid charging/releasing unit 46, a first decorative member 47, a second decorative member 49, first screws 50, an e-liquid storage chamber 51, a suction pipe 52, a copper wire 53, a protective jacket 54, a battery cell 55, a bracket 56, an anode press piece 57, a first silica plug 58, an anode connection piece 59, an anode contact 60, a circuit board 61, a fourth screw 62, a button 63, a bolt 64, an upper cell cover 65, a main body 66, a rear decorative member 67, a first threaded press piece 68, a second threaded press piece 69, a lower cover 70, an end cover 71, and a fifth screw 72.

The atomization module A comprises: a mouthpiece 1, an airflow regulation ring 2, an air blockage ring 7, a fixed ring 3 of the air blockage ring, a first seal ring 4, an upper cover 5, a seal ring 6 of the air blockage ring, a screw ring 8, a first press cover 9, an atomization support 11, a seal ring 10 of the atomization support, a meshed heating disc 12, e-liquid conducting cotton 13, a cotton support 14, an air plug 15, a first anode connection member 16, a second anode connection member 17, an e-liquid blockage member 18, a second seal ring 19, a third seal ring 20, a base 21, a fourth seal ring 22, a glass tube 23, a fixed ring 24 of the glass tube, a second press cover 25, a first insulator 26, and a bottom electrode 27. The first seal ring 4, the fixed ring 3 of the air blockage ring, the airflow regulation ring 2, and the mouthpiece 1 are disposed on the upper cover successively to form a cigarette holder and an airflow regulator of the electronic cigarette; the e-liquid blockage member 18 is disposed at a bottom of the second anode connection member 17; the air plug 15 and the first anode connection member 16 are embedded in an upper part of the second anode connection member 17 successively; the second anode connection member 17 comprises an e-liquid inlet; the meshed heating disc 12 is embedded in the atomization support 11; the e-liquid conducting cotton 13 is supported by the cotton support 14; the atomization support 11 is integrated with the cotton support 14; the seal ring 10 is positioned in the atomization support 11, and then sleeves the second anode connection member 17; the first press cover 9 is screwed on the first anode connection member 16; the meshed heating disc 12 is a circular metal heating net connected to the second anode connection member 17 and a cathode of the battery cell; and the circular metal heating net is connected to the cotton support 14, the e-liquid conducting cotton 13, and the atomization support 11. The second seal ring 19 and the third seal ring 20 are embedded in two upper grooves of the base 21, and the fourth seal ring 22 is embedded in a lower groove of the base 21; the fixed ring 24 of the glass tube is disposed in a groove of the second press cover 25, and the fixed ring 24 and the glass tube are embedded in the base 21 successively; the first insulator 26 and the bottom electrode 27 are disposed in a bottom hole of the base 21; the second anode connection member 17 is connected to the base 21; the cigarette holder is positioned on the base 21.

The e-liquid storage module C comprise: a cover 30, a press ring 40, a female threaded piece 41, a male threaded piece 42, a first spring 44, a supporting member 43 of the male threaded piece 42, a fifth seal ring 45, an e-liquid charging/releasing unit 46, an e-liquid storage chamber 51, a suction pipe 52, and a protective jacket 54. The female threaded piece 41 communicates with the e-liquid storage chamber 51, the male threaded piece 42 is supported by the supporting member 43; the first spring 44 and the e-liquid charging/releasing unit 46 are disposed in the supporting member 43; the fifth seal ring 45 sleeves the e-liquid charging/releasing unit 46; the press ring 40 and the suction pipe 52 are disposed on the supporting member 43 successively; the male threaded piece 42 corresponds to the female threaded piece 41, and the e-liquid storage chamber 51 is disposed in the protective jacket 54.

The battery module comprises: a sixth seal ring 28, a threaded plate 29, an upper electrode 31, a second screw 32, a third screw 33, a second spring 34, a lower electrode 35, an electrode cover 36, a second insulator 37, a first silica plug 38, a second silica plug 39, a first decorative member 47, a second decorative member 49, first screws 50, a copper wire 53, a battery cell 55, a bracket 56, an anode press piece 57, a first silica plug 58, an anode connection piece 59, an anode contact 60, a circuit board 61, a fourth screw 62, a button 63, a bolt 64, an upper cell cover 65, a main body 66, a rear decorative member 67, a first threaded press piece 68, a second threaded press piece 69, a lower cover 70, an end cover 71, and a fifth screw 72. The threaded plate 29 is disposed on the upper cell cover 65; the button 63 and the bolt 64 are embedded in the upper cell cover 65; the first silica plug 38, the second insulator 37, the second spring 34, the upper electrode 31 are disposed in the electrode cover 36 successively; the lower electrode 35 cooperates with the upper electrode 31; the upper electrode and the lower electrode are integrated with the threaded plate 29; the first threaded press piece 68 and the second threaded press piece 69 are integrated with the lower cover 70; the copper wire 53 is welded to the first threaded press piece 68 and disposed at a bottom of the main body 66; the second silica plug 39 is disposed on the bracket 56; the first silica plug 58 sleeves the anode press piece 57 and then is disposed at a bottom of the bracket 56; the anode connection piece 59 is disposed on an upper part of the bracket; the anode contact 60 is disposed on the bracket 56; the circuit board 61 is disposed on the bracket 56; the anode connection piece 59 is welded to an anode of the circuit board 61, and then is mounted in the main body 66; the copper wire 53 is welded to an cathode of the circuit board 61; the first decorative member 47, the second decorative member 49 and the rear decorative member 67 are fixed on the main body 66 via the first screws 50; the upper cell cover 65 is mounted on the main body 66 and locked by the fourth screw 62; the battery cell 55 is disposed in the main body 66; the end cover 71 is mounted on the lower cover 70 via the fifth screw 72. The structural arrangement of the battery module facilitates the replacement of the battery cell 55 by directly dismantling the end cover 71.

Preferably, the lower electrode 35 is embedded in the second silica plug 39; the lower electrode 35 is connected to the upper electrode 31; the upper electrode 31 is connected to and communicates with the bottom electrode 27 via the threaded plate 29. When the e-liquid storage chamber 51 is manually squeezed, the e-liquid is pumped by the suction pipe 52, enters the e-liquid charging/releasing unit 46, and then successively passes through the second silica plug 39, the lower electrode 35, the threaded plate 29, the bottom electrode 27 of the atomization module, the second anode connection member 17, and is stored in an e-liquid storage chamber of the atomization module. The structural design facilitates the manual operation for e-liquid output.

Preferably, the threaded plate 29 comprises a groove, which is conducive to the replacement of the atomization module; the female threaded piece 41 communicates with the e-liquid storage chamber 51; the press ring 40 and the fifth seal ring 45 are connected to the suction pipe 52; the e-liquid charging/releasing unit 46, the first spring 44, and the supporting member 43 are embedded in the male threaded piece 42 successively, integrated with the suction pipe 52, and then cooperate with the female threaded piece 41. The e-liquid can be charged to the e-liquid storage module without disassembling the electronic cigarette. During charging, a nozzle of an e-liquid container is vertically connected to the e-liquid charging/releasing unit, so that the e-liquid is charged to the e-liquid storage chamber 51 via the e-liquid charging/releasing unit 46.

Preferably, the e-liquid storage module comprises the first spring 44, the e-liquid charging/releasing unit 46, the fifth seal ring 45, and the press ring 40. During the charge of the e-liquid, the fifth seal ring 45 and the press ring 40 open under the drive of the first spring 44, a gap forms. Upon charging, the air is discharged from the gap between the supporting member 43 and the press ring 40, which is conducive to the charging. After the charging is finished, the press ring 40 is automatically sealed, preventing the leakage.

As shown in FIG. 1, the fixed ring 3 of the air blockage ring and the first seal ring 4 are disposed in grooves of the upper cover 5; the airflow regulation ring 2 is connected to the upper cover 5; the screw ring 8 and the air blockage ring 7 are fixed in the upper cover 5, and the mouthpiece 1 is disposed on the upper cover 5. The airflow regulation ring 2 is adapted to control the flow rate and volume of the air flow.

Preferably, the main body 66 comprises a first trench for accommodating the e-liquid storage chamber 51 and the protective jacket 54, and a second trench for accommodating the battery cell 55 and the bracket 56. The trenches facilitate the replacement of the battery cell. The e-liquid storage chamber 51 is embedded in the protective jacket 54 and then is positioned in the main body, preventing the deformation of the e-liquid storage chamber. The battery cell of the electronic cigarette can be dismantled and replaced as needed, and the battery cell is extracted from a through hole of the main body of the electronic cigarette, preventing the outer protective insulation layer of the battery cell from being damaged. The e-liquid is tightly sealed preventing the leakage. The arrangement of the airflow regulation ring facilitates the regulation of the flow rate of the vapor, increasing the user experience. The e-liquid can be refilled during the use of the electronic cigarette, through manually squeezing the e-liquid storage module, the e-liquid can be charged to the atomization module via an e-liquid inlet. When the charging is finished, the e-liquid inlet closes automatically, preventing the leakage of the e-liquid.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

1) an atomization module, the atomization module comprising: a mouthpiece, an airflow regulation ring, an air blockage ring, a fixed ring of the air blockage ring, a first seal ring, an upper cover, a seal ring of the air blockage ring, a screw ring, a first press cover, an atomization support, a seal ring of the atomization support, a meshed heating disc, e-liquid conducting cotton, a cotton support, an air plug, a first anode connection member, a second anode connection member, an e-liquid blockage member, a second seal ring, a third seal ring, a base, a fourth seal ring, a glass tube, a fixed ring of the glass tube, a second press cover, a first insulator, and a bottom electrode;

2) an e-liquid storage module, the e-liquid storage module comprising: a cover, a press ring, a female threaded piece, a male threaded piece, a first spring, a supporting member of the male threaded piece, a fifth seal ring, an e-liquid charging/releasing unit, an e-liquid storage chamber, a suction pipe, and a protective jacket; and 3) a battery module, the battery module comprising: a sixth seal ring, a threaded plate, an upper electrode, a second screw, a third screw, a second spring, a lower electrode, an electrode cover, a second insulator, a first silica plug, a second silica plug, a first decorative member, a second decorative member, first screws, a copper wire, a battery cell, a bracket, an anode press piece, a first silica plug, an anode connection piece, an anode contact, a circuit board, a fourth screw, a button, a bolt, an upper cell cover, a main body, a rear decorative member, a first threaded press piece, a second threaded press piece, a lower cover, an end cover, and a fifth screw;

wherein the atomization module is disposed on the battery module;

the first seal ring, the fixed ring of the air blockage ring, the airflow regulation ring, and the mouthpiece are disposed on the upper cover successively to form a cigarette holder and an airflow regulator of the electronic cigarette; the e-liquid blockage member is disposed at a bottom of the second anode connection member; the air plug and the first anode connection member are embedded in an upper part of the second anode connection member successively; the second anode connection member comprises an e-liquid inlet; the meshed heating disc is embedded in the atomization support; the e-liquid conducting cotton is supported by the cotton support; the atomization support is integrated with the cotton support; the seal ring is positioned in the atomization support, and then sleeves the second anode connection member; the first press cover is screwed on the first anode connection member; the second seal ring and the third seal ring are embedded in two upper grooves of the base, and the fourth seal ring is embedded in a lower groove of the base; the fixed ring of the glass tube is disposed in a groove of the second press cover, and the fixed ring and the glass tube are embedded in the base successively; the first insulator and the bottom electrode are disposed in a bottom hole of the base; the second anode connection member is connected to the base; the cigarette holder is positioned on the base;

the female threaded piece communicates with the e-liquid storage chamber, the male threaded piece is supported by the supporting member; the first spring and the e-liquid charging/releasing unit are disposed in the supporting member; the fifth seal ring sleeves the e-liquid charging/releasing unit; the press ring and the suction pipe are disposed on the supporting member successively; the male threaded piece corresponds to the female threaded piece, and the e-liquid storage chamber is disposed in the protective jacket;

the threaded plate is disposed on the upper cell cover; the button and the bolt are embedded in the upper cell cover; the first silica plug, the second insulator, the second spring, the upper electrode are disposed in the electrode cover successively; the lower electrode cooperates with the upper electrode; the upper electrode and the lower electrode are integrated with the threaded plate; the first threaded press piece and the second threaded press piece are integrated with the lower cover; the copper wire is welded to the first threaded press piece and disposed at a bottom of the main body; the second silica plug is disposed on the bracket; the first silica plug sleeves the anode press piece and then is disposed at a bottom of the bracket; the anode connection piece is disposed on an upper part of the bracket; the anode contact is disposed on the bracket; the circuit board is disposed on the bracket; the anode connection piece is welded to an anode of the circuit board, and then is mounted in the main body; the copper wire is welded to an cathode of the circuit board; the first decorative member, the second decorative member, and the rear decorative member are fixed on the main body via the first screws; the upper cell cover is mounted on the main body and locked by the fourth screw; the battery cell is disposed in the main body; the end cover is mounted on the lower cover via the fifth screw.

2. The electronic cigarette of claim 1, wherein the meshed heating disc is a circular metal heating net connected to the second anode connection member and a cathode of the battery cell; and the circular metal heating net is connected to the cotton support, the e-liquid conducting cotton, and the atomization support.

3. The electronic cigarette of claim 1, wherein the lower electrode is embedded in the second silica plug; the lower electrode is connected to the upper electrode; the upper electrode is connected to and communicates with the bottom electrode via the threaded plate.

4. The electronic cigarette of claim 2, wherein the lower electrode is embedded in the second silica plug; the lower electrode is connected to the upper electrode; the upper electrode is connected to and communicates with the bottom electrode via the threaded plate.

5. The electronic cigarette of claim 1, wherein the threaded plate comprises a groove; the press ring and the fifth seal ring are connected to the suction pipe; the e-liquid charging/releasing unit, the first spring, and the supporting member are embedded in the male threaded piece successively, integrated with the suction pipe, and then cooperate with the female threaded piece.

6. The electronic cigarette of claim 2, wherein the threaded plate comprises a groove; the press ring and the fifth seal ring are connected to the suction pipe; the e-liquid charging/releasing unit, the first spring, and the supporting member are embedded in the male threaded piece successively, integrated with the suction pipe, and then cooperate with the female threaded piece.

7. The electronic cigarette of claim 1, wherein the fixed ring of the air blockage ring and the first seal ring are disposed in grooves of the upper cover; the airflow regulation ring is connected to the upper cover; the screw ring and the air blockage ring are fixed in the upper cover, and the mouthpiece is disposed on the upper cover.

8. The electronic cigarette of claim 2, wherein the fixed ring of the air blockage ring and the first seal ring are disposed in grooves of the upper cover; the airflow regulation ring is connected to the upper cover; the screw ring and the air blockage ring are fixed in the upper cover, and the mouthpiece is disposed on the upper cover.

9. The electronic cigarette of claim 1, wherein the main body comprises a first trench for accommodating the e-liquid storage chamber and the protective jacket, and a second trench for accommodating the battery cell and the bracket.

10. The electronic cigarette of claim 2, wherein the main body comprises a first trench for accommodating the e-liquid storage chamber and the protective jacket, and a second trench for accommodating the battery cell and the bracket.

* * * * *